US010577157B2

(12) United States Patent
Shapiro

(10) Patent No.: US 10,577,157 B2
(45) Date of Patent: Mar. 3, 2020

(54) AIRFLOW COOLING LID

(71) Applicant: Akiva Shapiro, Old Bethpage, NY (US)

(72) Inventor: Akiva Shapiro, Old Bethpage, NY (US)

( * ) Notice: Subject to any disclaimer, the term of this patent is extended or adjusted under 35 U.S.C. 154(b) by 0 days.

(21) Appl. No.: 15/973,774

(22) Filed: May 8, 2018

(65) Prior Publication Data

US 2018/0257828 A1 Sep. 13, 2018

Related U.S. Application Data

(63) Continuation of application No. 15/050,757, filed as application No. PCT/US2015/010995 on Jan. 12, 2015, now Pat. No. 9,975,674.

(Continued)

(51) Int. Cl.
*B65D 51/16* (2006.01)
*B65D 43/02* (2006.01)

(Continued)

(52) U.S. Cl.
CPC ..... *B65D 51/1611* (2013.01); *A47G 19/2272* (2013.01); *B65D 21/02* (2013.01);

(Continued)

(58) Field of Classification Search
CPC .... B65D 51/1611; B65D 21/02; B65D 43/16; B65D 43/02; B65D 2543/00277;

(Continued)

(56) References Cited

U.S. PATENT DOCUMENTS 2,003,657 A 6/1935 Stubblefield
3,421,681 A 1/1969 Frank (Continued)

FOREIGN PATENT DOCUMENTS

KR 2003-0020154 A 3/2003
WO 2004047596 A1 6/2004
WO 2009055067 A2 4/2009

OTHER PUBLICATIONS

PCT International Search Report for PCT/US2015/010995 dated May 11, 2015.

(Continued)

*Primary Examiner* — Kareen K Thomas
(74) *Attorney, Agent, or Firm* — Carter, DeLuca & Farrell, LLP

(57) ABSTRACT

An airflow cooling lid for hot beverage containers enables the user to cool down the beverage in the container by blowing outside air across the surface of the beverage without removal of the lid. The airflow cooling lid includes a circular cover snuggly placed over a hot beverage container having a mounting rim, a surface portion, a sipping portal in form of an opening for consuming the beverage, an airflow opening to be used as either the intake or exhaust portal for the air drawn over the surface of the beverage, and a pinhole vent opening for allowing outside air into the container and pressure release in the event both portals are plugged. The airflow portal is angled outward to allow the exhaust air to flow away from the face when blowing through either portal.

19 Claims, 5 Drawing Sheets

Related U.S. Application Data

(60) Provisional application No. 62/021,239, filed on Jul. 7, 2014, provisional application No. 61/970,272, filed on Mar. 25, 2014.

(51) Int. Cl.
*A47G 19/22* (2006.01)
*B65D 21/02* (2006.01)
*B65D 43/16* (2006.01)

(52) U.S. Cl.
CPC ..... *B65D 43/02* (2013.01); *B65D 43/0202* (2013.01); *B65D 43/16* (2013.01); *B65D 2251/009* (2013.01); *B65D 2251/0021* (2013.01); *B65D 2543/00046* (2013.01); *B65D 2543/00092* (2013.01); *B65D 2543/00277* (2013.01); *B65D 2543/00296* (2013.01); *B65D 2543/00305* (2013.01); *B65D 2543/00537* (2013.01)

(58) Field of Classification Search
CPC ..... B65D 2543/00296; B65D 2543/00092; B65D 2251/009; B65D 2251/0021; B65D 2543/00046; A47G 19/2272
USPC ..... 220/713, 212, 521, 780, 254.1, 367.1, 220/231, 271, 260, 360, 361, 366.1, 368, 220/373
See application file for complete search history.

(56) References Cited

U.S. PATENT DOCUMENTS 3,727,808 A * 4/1973 Fitzgerald ..... A47G 19/2272 222/482
3,994,411 A 11/1976 Elfelt et al.
4,589,569 A 5/1986 Clements
4,721,210 A 1/1988 Lawrence
D323,116 S 1/1992 Dart
5,582,315 A 12/1996 Reid
6,176,390 B1 1/2001 Kemp
6,260,727 B1 7/2001 Durdon
6,488,173 B2 12/2002 Milan
6,929,143 B2 8/2005 Mazzarolo
7,185,781 B2 3/2007 Pitts
7,959,029 B2 6/2011 Whitaker
8,267,275 B2 9/2012 Peitersen
8,322,562 B2 12/2012 Dybala
8,459,491 B2 6/2013 Savenok
D704,054 S 5/2014 Fleming
8,881,938 B2 11/2014 Brannock
9,975,674 B2 5/2018 Shapiro
2005/0127075 A1 6/2005 Smith
2005/0205588 A1 9/2005 Pitts
2006/0037962 A1 2/2006 Kim
2007/0075079 A1 4/2007 Stokes
2007/0075080 A1 4/2007 Farnsworth et al.
2007/0075081 A1 4/2007 Stokes
2008/0217345 A1 9/2008 Hansen
2009/0065518 A1* 3/2009 Carnevali ..... B65D 43/0212 220/711
2009/0108006 A1 4/2009 Milan
2012/0080441 A1 4/2012 Lin
2013/0001233 A1* 1/2013 Hylton ..... A47G 19/2272 220/592.2
2014/0042178 A1 2/2014 Brannock

OTHER PUBLICATIONS

PCT Written Opinion of the Internatioinal Searching Authority for PCT/US2015/010995 dated May 11, 2015.

* cited by examiner

AIRFLOW COOLING LID

CROSS-REFERENCE TO RELATED APPLICATIONS

This application is a continuation application of U.S. patent application Ser. No. 15/050,757, filed on Feb. 23, 2016, which is a national stage entry of PCT/US15/10995, filed on Jan. 12, 2015, which claims the benefit of and priority to U.S. Provisional Patent Application Nos. 62/021,239, filed on Jul. 7, 2014, and 61/970,272, filed on Mar. 25, 2014, the entire contents of which being incorporated by reference herein.

BACKGROUND

1. Technical Field

The present disclosure is generally in the technical field of beverage containers, and, more particularly, is in the field of lids for beverage containers.

2. Background of Related Art

Consumers burning their lips, tongue, mouth, arms, legs, and torso from hot coffee, tea and other beverages continues to be a problem. The principal source of such scaldings have been believed to be scalding hot liquid in combination with lid, cup, or lid/cup sets that are designed allow drinking through the lid while retain heat.

Change in this field has been slow. The first beverage lid that allowed consumption of the liquid without removing the top was originally invented by Roy Irvin Stubblefield in 1934 (U.S. Pat. No. 2,003,657). The liquid was drawn through a slit depressed by the consumer's mouth. It wasn't until more than thirty years later that the first major improvement was made by Alan Frank, who invented the peel back opening in 1967 (U.S. Pat. No. 3,421,681A). It took another decade before the next major improvement, namely a tab to hold the Frank's peeled back opening so it didn't have to be torn off or held open (U.S. Pat. No. 3,994,411A).

What followed since then are dozens of variations on the Stubblefeld's lid, offering a wide variety of configurations, from the dome lid, to re-closeable drinking openings, to temperature sensing, specialized labeling, and even a number of complicated attempts at providing a cooling capability.

The most economical of existing lids is typically manufactured with two openings—the drinking opening and the vent opening. The vent opening is pin-sized and placed substantially in the middle of the lid, but may be found elsewhere on the lid. It is made purposefully small in order to serve the three purposes of syphoning the outside air into the container to replace the consumed beverage, preventing spillage, and as pressure release if the drinking opening is plugged. However, these pin holes are too small to allow for liquid to be sipped therethrough It is undisputed that even with conventional lids the user is able to cool down the beverage by blowing outside air into the drinking opening. However, most of the high-humidity air merely swirls around the surface of the beverage and remains inside the container, which has a nominal effect on cooling down the beverage.

Other prior art directed towards solving the problem of cooling down hot beverages include: Reservoir cooling; heat transfer at the point of consumption; bellows cooling; and ridge cooling.

Reservoir cooling suffers firstly, from requiring the beverage to initially escape from the inner portion of the container, thereby creating a possibility of spillage as there is nothing to prevent overflow. Secondly, the reservoir can only hold a small amount of fluid, which means that the invention would have no effect on the temperature of the consumed beverage if the user sipped in more fluid than the volume of the reservoir. Thirdly, the container needs to be constantly tipped upward, which is both impractical and dangerous in driving applications. And fourthly, the process of manufacture is significantly more complicated and costly. See U.S. Pat. No. 6,176,390 B1, US20060037962 A1, US20090108006 A1, US20090108006 A1, U.S. Pat. No. 8,267,275 B2, US20120080441 A1, WO2009055067 A2, WO2004047596 A1, U.S. Pat. No. 8,459,491 B2, U.S. Pat. No. 6,488,173 B2.

Heat transfer at the point of consumption cooling suffers firstly, from the fluid consumed during the initial stage of each sip cannot be sufficiently cooled as the cooling airflow is yet to be drawn over the liquid. Secondly, the hot vapor is directed towards the consumer's mouth, rather than in the opposite direction, which can amplify the scalding effect of the hot beverage. See U.S. Pat. No. 7,185,781, U.S. Pat. No. D704,054 S, U.S. Pat. No. 8,881,938 B2, US20140042178 A1.

Bellows cooling suffers firstly, from a mechanically complex device, which significantly increases the cost of manufacturing. Secondly, it is bulky, which, in turn, negatively affects the cost of stacking, storage and transportation. And thirdly, and more importantly, the device is unsafe for driving applications as it requires the user to use both hands: one hand to hold the cup and the other to push the bellows. See U.S. Pat. No. 8,322,562 B2.

Ridge cooling suffers firstly, from a mechanically complex device, which increases the cost of manufacturing. Secondly, the invention comprises a protruding lip which extends beyond the dimensions of the cup, causing an unconventional displacement when in daily use. See US20080217345 A1.

See also U.S. Pat. No. 6,929,143 B2, U.S. Pat. No. 6,260,727 B1, U.S. Pat. No. 4,589,569 A, US2007/0075080 A1, none of which provide a cooling mechanism.

Typically, in order to accelerate cooling a hot beverage, the consumer will either dilute the beverage by adding cold water, ice or more milk than desired, thereby reducing the palatability of the beverage, or open the container to let the beverage cool down, which is often impractical and can result in a messy spillage causing skin burns or clothing stains. Other prior art, not widely in use, as described above, may also enable faster cooling, albeit at the price of a complicated apparatus that is bulky, expensive to produce, and/or inconvenient and potentially unsafe—especially when driving.

Accordingly, there are no economically produced lids that provide a means for the consumer to simply, effectively, inexpensively, safely, and conveniently finely control the rate at which the liquid temperature decreases, thereby achieving a rapid and personalized optimal temperature for consumption.

SUMMARY

In accordance with an aspect of the present disclosure, a lid is provided which allows the consumer, in one economical configuration, to blow air across the contents to cool it, and sip liquid contents, with ease.

If desired, particular embodiments may optionally include a method and/or mechanism for directing the exhaust away from the consumer's face.

In one aspect, a beverage lid is provided that empowers the consumer to simply, effectively, inexpensively, safely, and conveniently finely control the rate at which the liquid temperature decreases, thereby achieving a rapid and personalized optimal temperature for consumption.

In aspects of the present disclosure, provided is an improved lid for hot beverage containers that enables the user to cool down the hot beverage without removal of the lid by blowing air across the surface of the beverage. Adding an adequately sized and appropriately positioned exhaust opening creates an escape route for high-humidity hot air, allowing it to be displaced by low-humidity cooler air blown into the other opening. The lid is elegant, as simple to manufacture as the current market dominant lid configurations, cost effective, and convenient.

In an exemplary embodiment, the drinking opening and/or exhaust opening are angled to direct the high-humidity hot air away from the consumer's face.

BRIEF DESCRIPTION OF DRAWINGS

Embodiments of the present disclosure are described herein with reference to the accompanying drawings, wherein.

DETAILED DESCRIPTION

The following is a detailed description of the invention provided to aid those skilled in the art in practicing in the field of the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Referring to FIG. 1-5, Cup, 9, is shown for exemplary purposes and is disclaimed.

Figure 1:
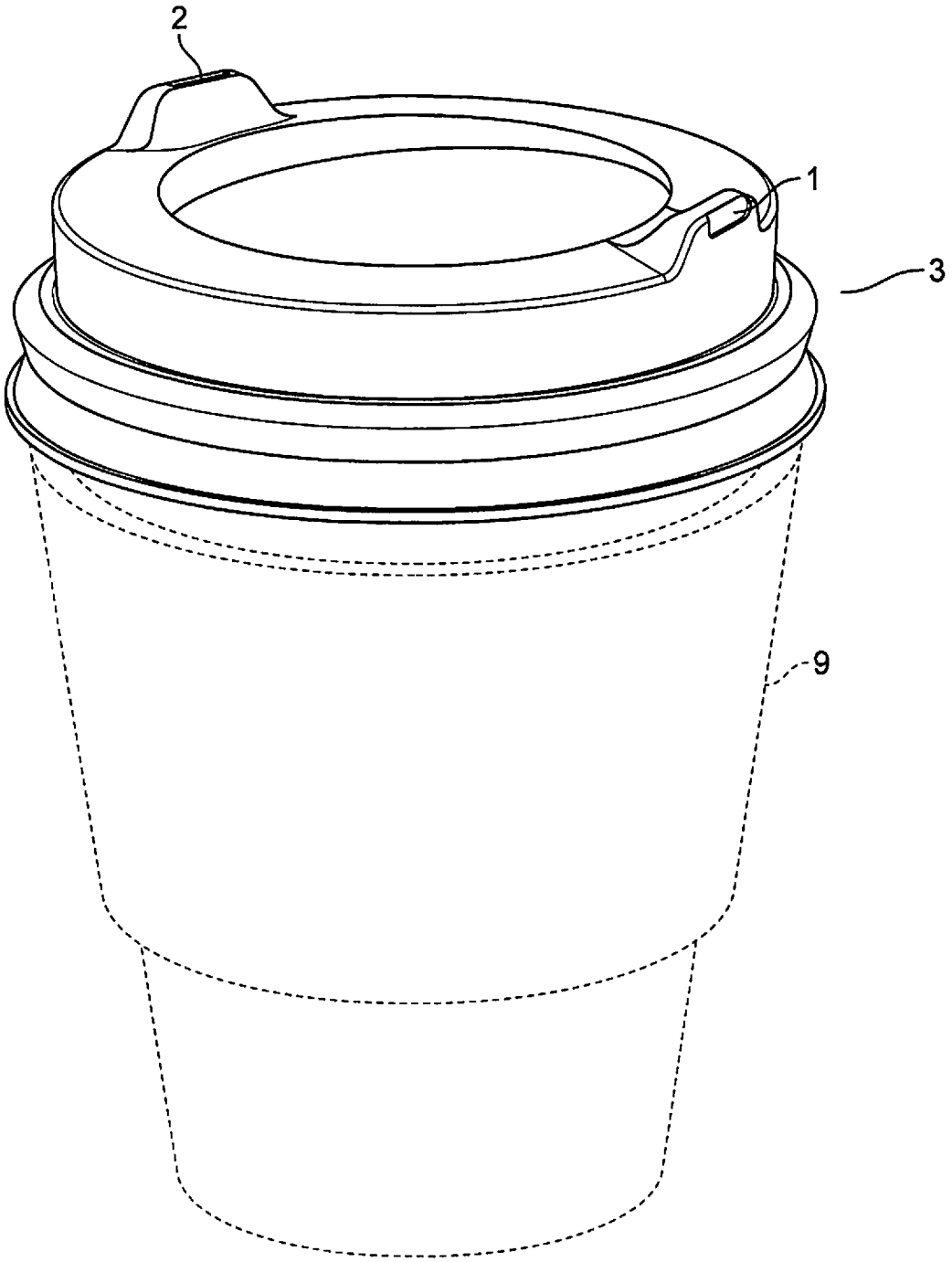
FIG. 1 is an isometric rear view of a dome lid showing the exhaust opening of the lid on a disclaimed cup.

One exemplary mode of carrying out the embodiment, though not exclusively, is manufacture of the lid, substantially as depicted in FIG. 1. At present I believe that this embodiment operates most efficiently, but other embodiments are also satisfactory.

With lids having sidewalls, 3 of FIG. 1, the exhaust opening, 1, may be placed on the sidewall or onto the upper surface of the lid diagonally opposite to the drinking opening, 2, or in any convenient location to achieve the result. With lids having no sidewalls, FIG. 5, the exhaust opening, 1, is placed onto the upper surface of the lid diagonally opposite to the drinking opening or in any convenient location to achieve the result.

Figure 2:
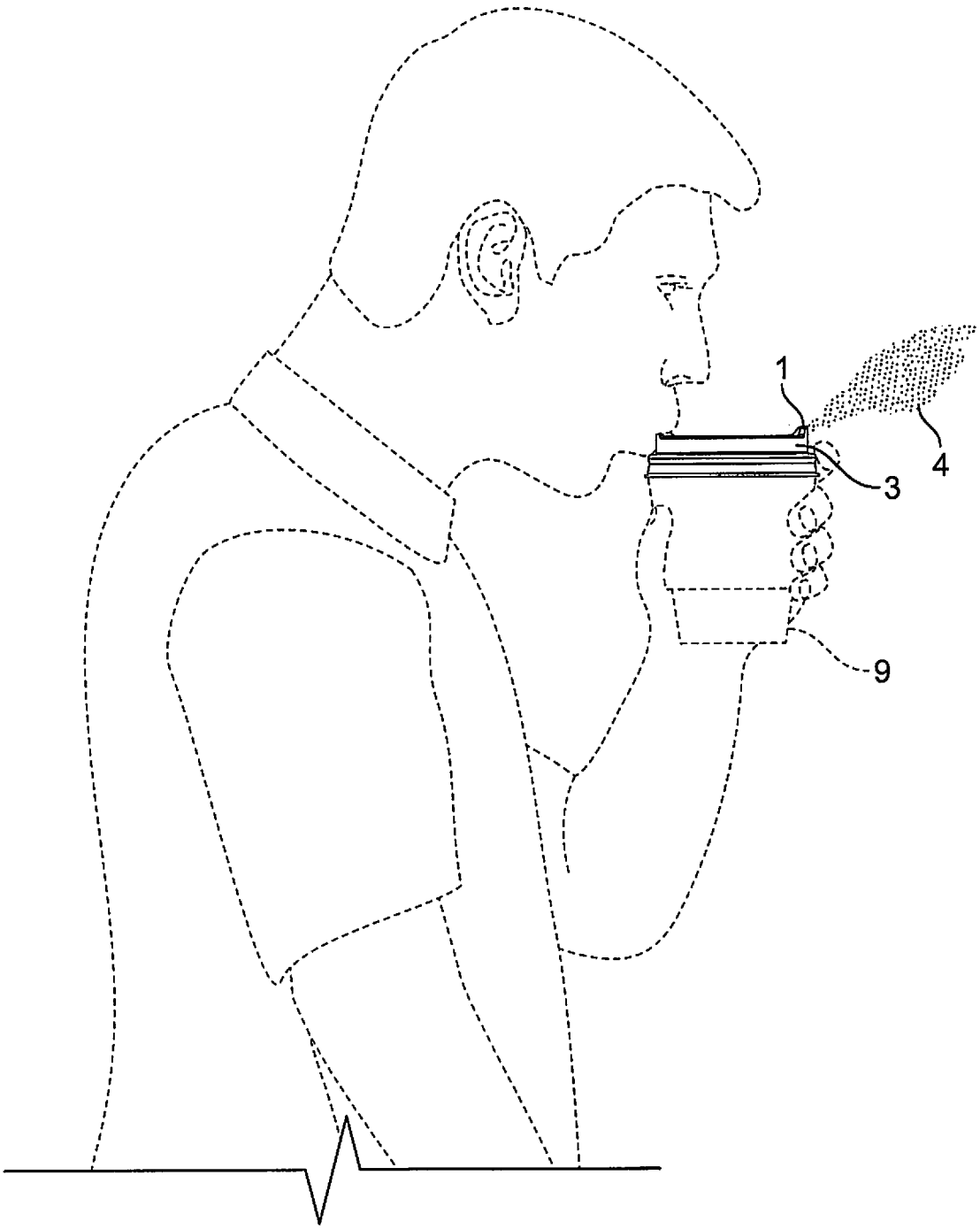
FIG. 2 is a side view of the dome lid showing a consumer (who is drawn in dashed line) blowing into the drinking opening, with steam exiting the exhaust opening, away from the consumer.
Figure 3:
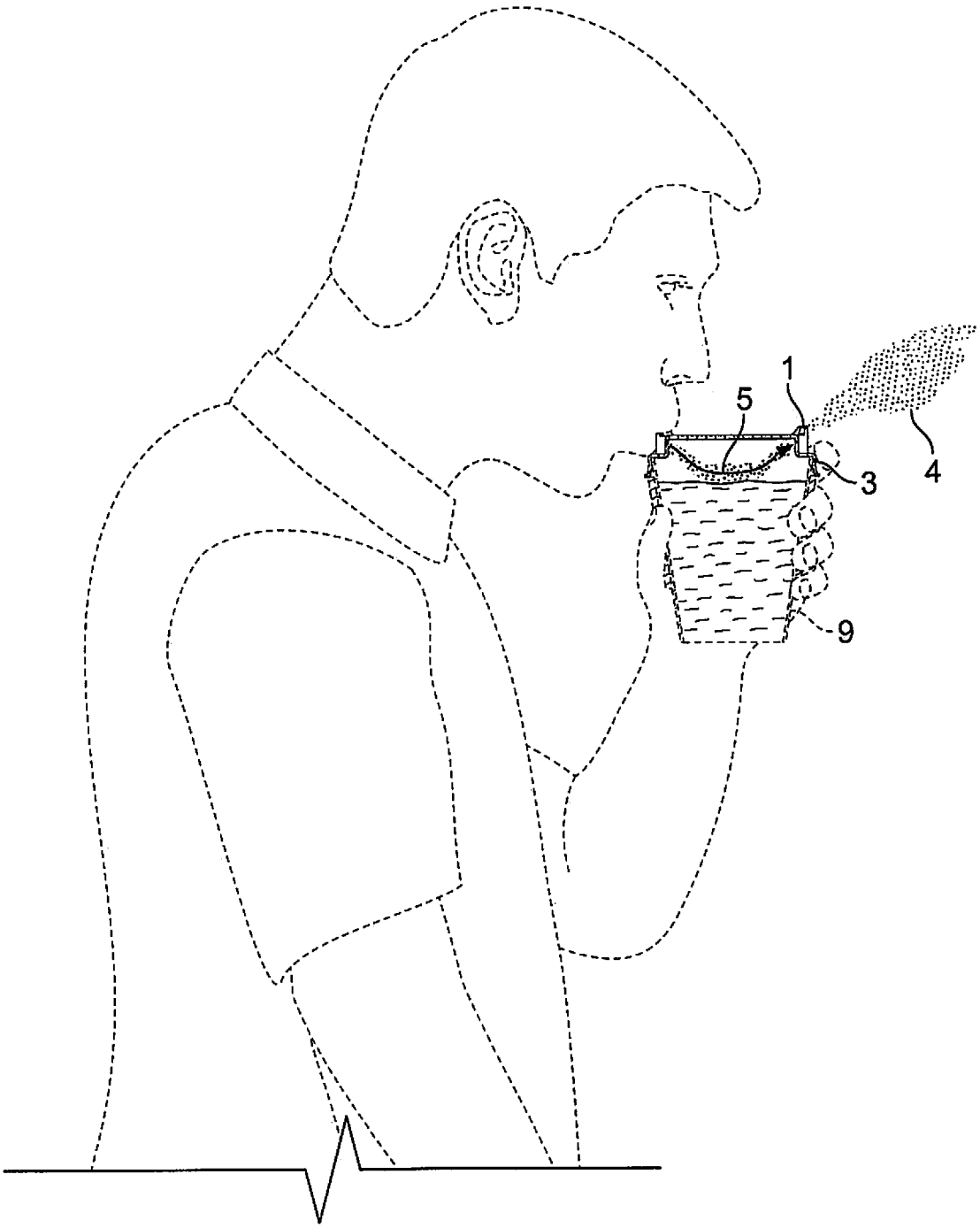
FIG. 3 is a section side view, showing air circulating from the drinking opening turbulently over the horizontal surface of the liquid 5 and out the exhaust opening away from the consumer.
Figure 4:
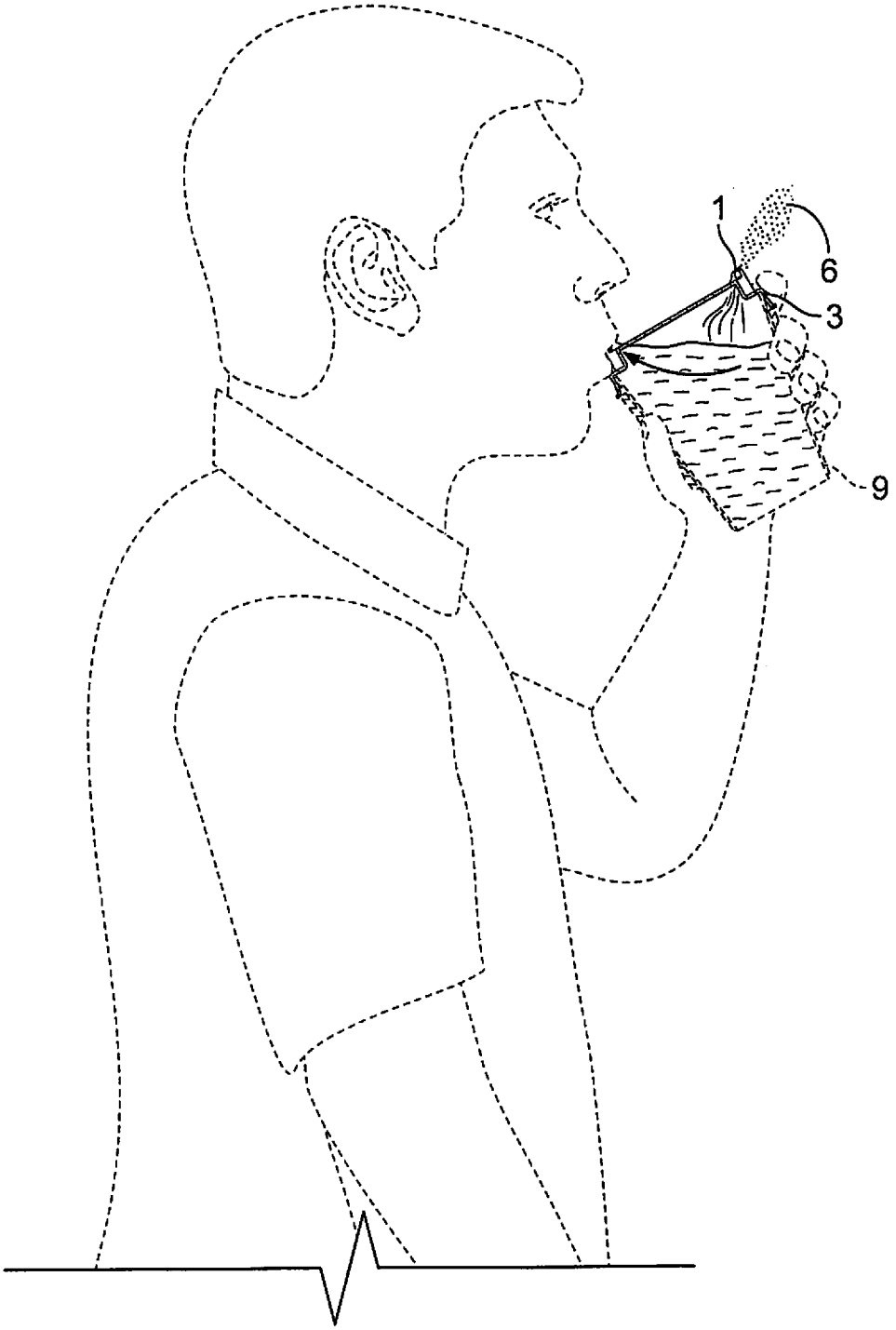
FIG. 4 is a section side view, illustrating the cup in a tilted state, with the fluid in the cup being consumed via the drinking opening, and a small amount of steam 6 being directed away from the consumer (who is drawn in dashed line)

One variation is to angle either or both openings so as to direct the driven exhaust, 4, away from the face of the consumer, as depicted in FIG. 2 and FIG. 3.

As noted, depending on the embodiment, either opening may be used for drinking or blowing. Another variation is to have neither opening angled.

It is not necessary that the two openings be of the same shape and size.

Figure 5:
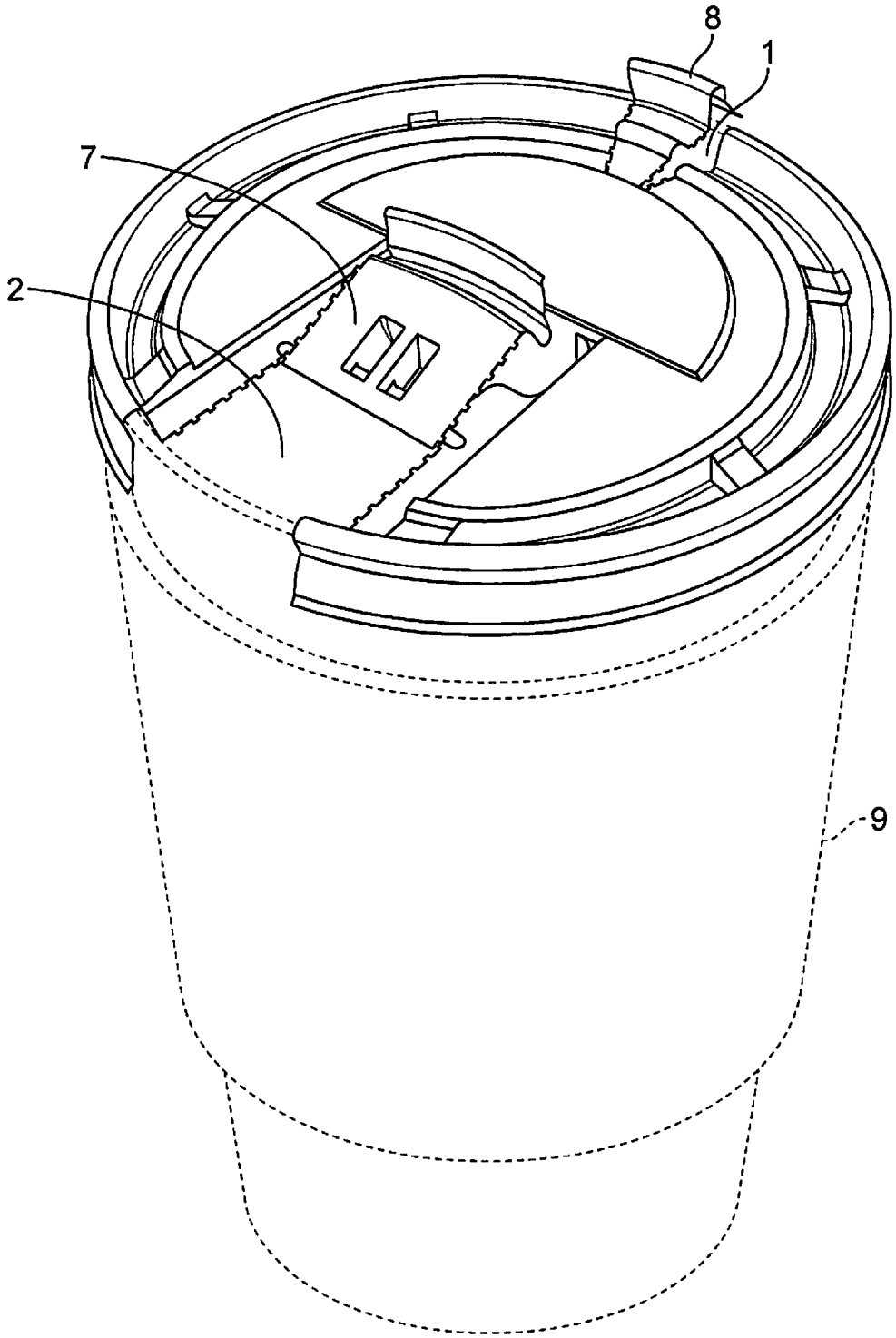
FIG. 5 is an isometric side view of a flat lid showing the exhaust opening with a cup, in phantom, under the lid.

In some exemplary embodiments of a lid having no sidewall, FIG. 5, a perforated flap, 8, is peeled back to reveal exhaust opening, 1, substantially as drinking opening, 2, in common flat lids, is revealed by peeling back perforated flap, 7.

In some exemplarily embodiments, the airflow opening comprises a plurality of pin-sized perforations. Each pin-sized perforation may be comparable in size with the standard vent opening in widespread use, or larger as needed to allow for sufficient throughput, and are best if small enough so that the liquid does not spill out in significant quantities if the container tilts or tips over. The plurality of the perforations combined together allows airflow sufficient to enable the humidity displacement at normal blowing pressure. The actual configuration of the plurality of holes can vary to any number and at any angle relative to the drinking opening.

In some exemplarily embodiments, the airflow opening comprises a slit aperture. The slit aperture is closed when no air is blowing through it; thus, ensuring that no excessive spillage occurs. The slit may be perforated so it remains sealed until the perforation is broken. Applying pressure to break the perforations unseals the slit aperture; once the slit aperture is unsealed, the airflow passes through it when the user blows in through the drinking opening. A variation is when the user ceases blowing, the slit closes.

In some exemplarily embodiments, the exhaust opening includes a flap to reduce likelihood of spillage.

In some exemplarily embodiments, the flap opening comprises a spring means for holding the flap closed. Blowing air causes the flap to open, and the spring means causes it to close when the airflow ceases.

Yet in other exemplarily embodiments, the flap opening comprises a rubber or plastic plug with rubber edges or a rubber grommet and a spring means. Blowing air in causes the plug to open, and the spring means causes it to close when the airflow ceases.

Typical manufacture of the lid is in plastic, on an automatic thin-gauge thermoforming machine with cast aluminum molds.

The lid can be made of any other sufficiently rigid material, including, but not limited to, molded plastic, biodegradable material, metals, ceramics, and the like.

The embodiment is ideal for licensing to existing manufacturers who may add this variation to their product line by the mere construction of an additional mold for each variation.

Quality control of the lid will include the exhaust-flow test, squeeze test, put-on test, stack test and the upside down test. The exhaust-flow test is to ensure that the exhaust is directed at a sufficient angle so as not to blow in the consumers face when the consumer blows from either opening if that variation is used. The squeeze test is to ensure the lid does not pop off easily when affixed to the beverage container and the beverage container is squeezed in accordance with the way consumers may squeeze the cup. The put-on test is to ensure that the lid can be affixed to the beverage container without undue difficulty. The stack test is to ensure the lid will stack evenly and without displacement irrespective of the planar orientation of the openings. The upside down test is to ensure the lid does not disengage when the beverage is turned upside down.

The forgoing industrial applicability discussions have been presented for purposes of illustration and description. They are not intended to be exhaustive or to limit the precise forms disclosed and many modifications and variations are possible in light of the above teachings. They were chosen and described in order to best explain principles and practical application to enable others skilled in the art to utilize the various embodiments with various modifications as are suited to the particular use contemplated.

The forgoing embodiments have been presented for purposes of illustration and description. They are not intended to be exhaustive or to limit the precise forms disclosed and many modifications and variations are possible in light of the above teachings. The embodiments were chosen and described in order to best explain principles and practical application to enable others skilled in the art to utilize the various embodiments with various modifications as are suited to the particular use contemplated.

What is claimed is:

1. A lid for a drinking cup, comprising:

a cover portion configured to be positioned on an opened end of a drinking cup;

a first opening defined adjacent a periphery of the cover portion; and a first portion extending from the cover portion and having a side surface facing radially outward from the cover portion, the side surface defining a second opening therein, the second opening being in fluid communication with the first opening and configured to direct exhaust air away from a consumer's face when blowing through the first opening, wherein the first and second openings are configured to enable a consumer, without removing the lid from a drinking cup, to drink or sip liquid contents through at least one of the first or second openings, or blow air through at least one of the first or second openings, wherein the first opening faces a first direction and the second opening faces a second direction, the first and second directions being substantially perpendicular to one another.

2. The lid according to claim 1, further comprising a second portion extending from the periphery of the cover portion, the second portion defining the first opening therein.

3. The lid according to claim 2, wherein the first and second portions are nozzles extending from opposite sides of the periphery of the cover.

4. The lid according to claim 1, wherein each of the first and second openings defines a plane, the plane of the second opening being substantially perpendicular to the plane of the first opening.

5. The lid according to claim 4, wherein the cover portion defines a plane substantially parallel with the plane of the first opening and substantially perpendicular to the plane of the second opening.

6. The lid according to claim 1, wherein the first portion is angled away from the first opening.

7. A lid for a drinking cup, comprising:

a cover portion configured to be positioned on an opened end of a drinking cup;

a first opening defined adjacent a first side of a periphery of the cover portion and facing a first direction; and a second opening defined adjacent a second side of the periphery of the cover portion, the second opening being in fluid communication with the first opening and facing a second direction that is different from the first direction, such that the second opening directs exhaust air in the second direction away from a consumer's face when blowing through the first opening, wherein the first and second openings are configured to enable a consumer, without removing the lid from a drinking cup, to drink or sip liquid contents through at least one of the first or second openings, or blow air through at least one of the first or second openings.

8. The lid according to claim 7, wherein each of the first and second openings defines a plane, the plane of the second opening being substantially perpendicular to the plane of the first opening.

9. The lid according to claim 8, wherein the cover portion defines a plane substantially parallel with the plane of the first opening and substantially perpendicular to the plane of the second opening.

10. The lid according to claim 7, wherein the cover portion has a side surface that defines the second opening.

11. The lid according to claim 7, further comprising a first nozzle extending from the second side of the periphery of the cover portion, the first nozzle having a side surface defining the second opening therein.

12. The lid according to claim 11, further comprising a second nozzle extending from the first side of the periphery of the cover portion, the second nozzle defining the first opening.

13. The lid according to claim 11, wherein the first nozzle is angled away from the first opening.

14. The lid according to claim 7, wherein the first and second sides of the periphery are diametrically opposed to one another.

15. The lid according to claim 7, wherein the cover portion defines a pinhole vent opening for allowing outside air into the drinking cup and pressure release.

16. The lid according to claim 7, further comprising a nozzle extending from the second side of the cover portion, wherein the nozzle defines the second opening therein.

17. The lid according to claim 16, wherein the nozzle extends upwardly from the cover portion.

18. The lid according to claim 17, wherein the nozzle extends at a non-parallel angle relative to the first direction.

19. The lid according to claim 7, wherein the second direction is from 10 degrees to 90 degrees from the first direction.

* * * * *